United States Patent [19]

Moerk, Jr.

[11] 4,033,702

[45] July 5, 1977

[54] ASSEMBLIES FOR SEALING ROADWAY CURB GAPS AND METHOD OF SEALING SAME

[75] Inventor: John C. Moerk, Jr., Buffalo Grove, Ill.

[73] Assignee: Felt Products Mfg. Co., Skokie, Ill.

[22] Filed: Aug. 7, 1975

[21] Appl. No.: 602,684

[52] U.S. Cl. ..... 404/69; 404/74; 52/396; 49/475

[51] Int. Cl.[2] ..... E01C 11/02

[58] Field of Search ..... 404/68, 64, 69, 65, 404/47, 74; 52/396, 403, 573; 49/475

[56] References Cited

UNITED STATES PATENTS

| | | | |
|---|---|---|---|
| 3,321,881 | 5/1967 | Alleaume | 52/573 X |
| 3,713,368 | 1/1973 | McDowell | 404/69 |
| 3,814,530 | 6/1974 | Neff | 404/74 X |
| 3,829,229 | 8/1974 | Britton | 404/69 |
| 3,880,541 | 4/1975 | McDowell | 404/74 |
| 3,881,835 | 5/1975 | Moerk | 404/74 X |

FOREIGN PATENTS OR APPLICATIONS

| | | | |
|---|---|---|---|
| 426,913 | 6/1967 | Switzerland | 404/64 |
| 504,570 | 4/1939 | United Kingdom | 404/65 |

*Primary Examiner*—Nile C. Byers

*Attorney, Agent, or Firm*—Dressler, Goldsmith, Clement, Gordon & Shore, Ltd.

[57] ABSTRACT

An assembly for sealing the intersection of curb and gutter portions of adjacent roadway slabs, including side pads joined by an upstanding joint membrane and a sealing flap extending away from them. The sealing flap is more flexible than the joint membrane, but has a relatively rigid zone positioned to promote folding of the flap between the side pads and below the joint membrane when the side pads are secured to the curb portions. The folding takes place without bunching and wrinkling to provide a smooth and neat transition from the curb to the gutter portions to promote effective sealing. A method of installing that assembly is also disclosed. Further, an assembly for sealing the gap between curb and sidewalk portions is disclosed, in which a flexible sealing flap extends from the upper ends of side pads joined by a flexible joint membrane and in which the highly flexible sealing flap is folded and reverse folded to provide a convolution adapted to be sealingly secured to a sidewalk end dam section, with the regions of the flap at the intersection of the curb and gutter portions forming a V-shaped configuration which merges with the convolution and with the joint membrane without wrinkling or bunching.

16 Claims, 19 Drawing Figures

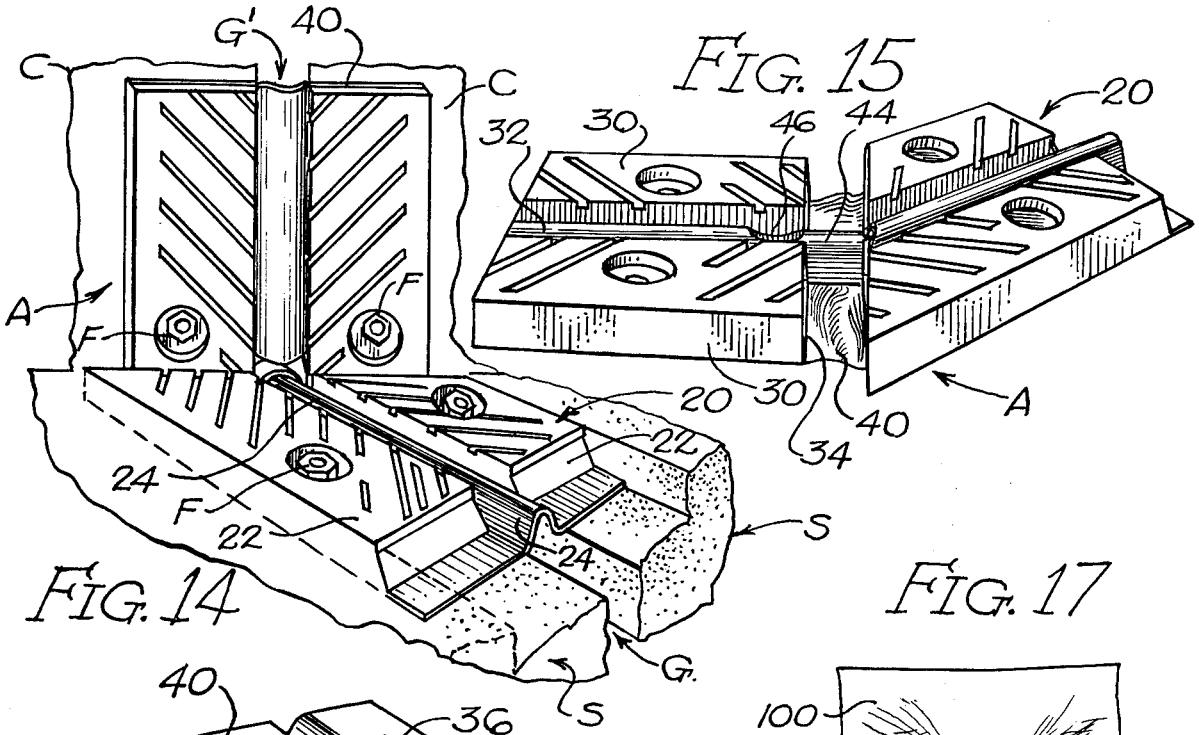
G'
40
C
C
A
F
F
20
24
F
22
24
S
G.
S
FIG. 14
FIG. 15
20
32
30
46
44
30
34
40
A
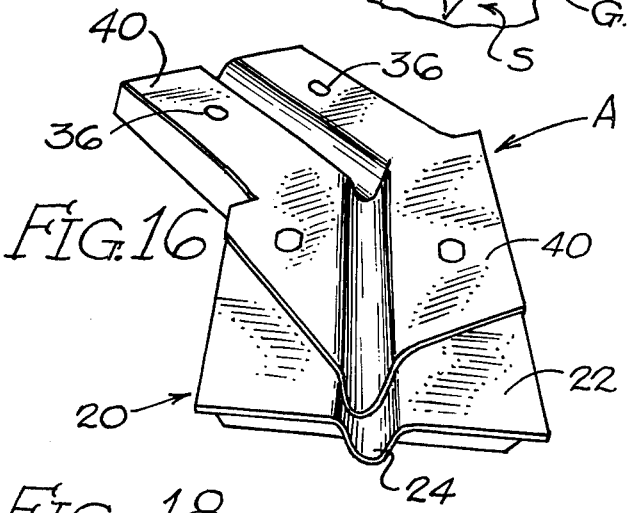
40
36
36
A
40
22
20
24
FIG. 16
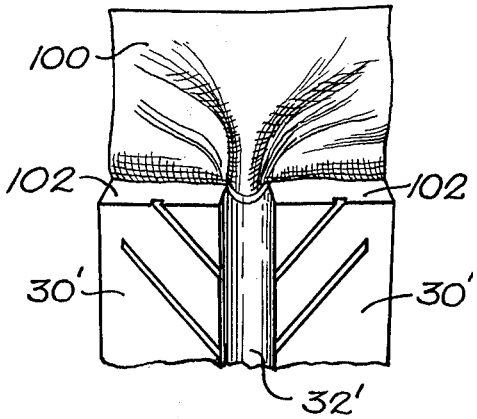
FIG. 17
100
102
102
30'
30'
32'
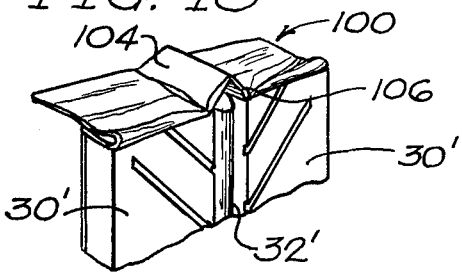
FIG. 18
104
100
106
30'
30'
32'
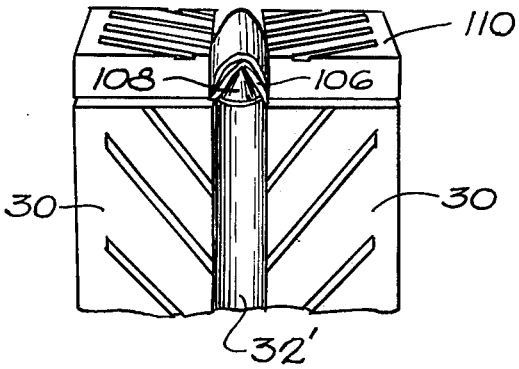
FIG. 19
110
108
106
30
30
32'

ASSEMBLIES FOR SEALING ROADWAY CURB GAPS AND METHOD OF SEALING SAME

This invention relates to an improved joint assembly for sealing a narrow gap between roadway slabs at curb portions of such slabs.

It is known to be important to seal the gap between adjacent roadway slabs, thereby to prevent the passage of water and debris through the gap and to maintain the integrity of the slabs at the gap. Because elevated highway and bridge roadway slabs move relative to each other, both under dynamic loading and in response to changes in weather conditions, it is necessary that the sealing device, in addition to sealing against the passage of water, debris and the like, must also accommodate and respond to relative movement of the adjacent slabs, and without damage to the slabs.

Various suggestions have been made for sealing the gaps between adjacent roadway slabs. A recent effective innovation for accomplishing such sealing is disclosed in U.S. Pat. No. 3,713,368, issued on Jan. 30, 1973.

Further, various approaches to the sealing of the intersections of curb and gutter portions of adjacent roadway slabs have been suggested. Some of these have been peculiarly adapted for use in connection with the sealing construction disclosed in U.S. Pat. No. 3,713,368, and these include the methods and devices shown in U.S. Pat. Nos. 3,814,530 and 3,880,541. Other approaches to the sealing of curb and gutter intersections have been suggested and attempted, and one such example is that shown in U.S. Pat. No. 3,650,184.

Even though sealing may be accomplished in accordance with one or more of the prior art methods and devices, still simpler and more effective means for sealing of the intersections of curb and gutter portions of adjacent roadway slabs would be of advantage. It is with such an improved curb and gutter sealing assembly and method that this invention is concerned.

Further, this application is concerned with improvements in the sealing of curb and sidewalk intersections and gaps between slabs forming curb and sidewalk portions. Prior approaches to such sealing are disclosed in several of the aforementioned patents, and in recently issued U.S. Pat. No. 3,881,835.

This invention is directed to an assembly for sealing the intersection of curb and adjacent gutter or sidewalk portions of adjacent roadway slabs, the assembly comprising elongate parallel, spaced-apart side pads having front and rear surfaces and first and second ends, an elongate flexible joint membrane having a pre-formed, self-sustaining, upstanding arched configuration and sealingly joining the side pads, and having front and rear surfaces, and an expansive flexible sealing flap sealingly secured to the side pads and joint membrane for sealing a gap between portions of adjacent roadway slabs and for promoting controlled folding of the sealing flap at the region where angular transition from the plane of the curb to the plane of the gutter or sidewalk occurs.

Where the assembly seals a curb and gutter gap intersection, the joint membrane terminates above the first lower ends of the side pads a distance which is equal at least to about the thickness of the side pads. The flexible sealing flap extends away from the side pads and is substantially more flexible than is the joint membrane, but has a self-sustaining, upstanding arched control zone which is of greater rigidity than the main body of the sealing flap. The control zone commences at about the first ends of the sides pads and extends away from the first ends a distance equal to at least about the thickness of the side pads when the side pads and flap are generally coplanar and extends in line with the joint membrane. The control zone is connected to the joint membrane by an intermediate highly flexible portion of the main body of the flap.

When the side pads and joint membrane are folded upwardly out of the plane of the sealing flap and relative to the sealing flap, the control zone promotes controlled folding of the intermediate flexible portion neatly between the joint membrane and the control zone, and the control zone becomes disposed in the region between the side pads and beneath the joint membrane, and without bunching and wrinkling of the intermediate flexible portion.

The flexible sealing flap is preferably sealingly secured to the rear surfaces of the side pads and of the joint membrane, and when the side pads and the joint membrane are upstanding and the rear surfaces of the side pad lie in a plane disposed at a substantial angle to the plane of the portion of the flexible sealing flap which extends away from the side pads, the intermediate flexible portion neatly overlies and confronts the control zone and is shaped by the control zone into a configuration which is similar to the shape of the control zone.

When the gap sealed by the assembly is at the intersection of curb and sidewalk portions of the adjacent slabs, the expansive flexible sealing flap is sealingly secured to the rear surfaces of the side pads and joint membrane and extends from the upper ends of the side pads and the joint membrane, extends rearwardly and away from the front surfaces of the pads, and overlies and confronts adjacent sidewalk portions of the roadway slabs and gap.

The flexible sealing flap is more highly flexible than the joint membrane and comprises first flap portions overlying the upper ends and reverse folded portions overlying the first flap portions, and a central flap portion which defines a convolution of an upstanding arched configuration intermediate the reverse folded portions, and a generally V-shaped flap region which merges with the convolution and the joint membrane without wrinkles or bunching.

Further objects, features and advantages of this invention will become apparent from the following description and drawings, of which:

FIG. 14 is a view similar to FIG. 13 in which a gutter gap bridging member is juxtaposed with the curb and gutter sealing assembly of FIG. 13;

FIG. 15 is a view of the assembly of FIG. 14 which has been pre-assembled for use with a gap of a predetermined substantial skew;

FIG. 16 is a bottom view of the assembly of FIG. 15;

FIG. 17 is a front view of a curb-sidewalk sealing assembly of this invention;

FIG. 18 is a view of the assembly of FIG. 17 manipulated to a position ready to be assembled with a sidewalk sealing member; and FIG. 19 is a view, similar to FIG. 18, assembled with a sidewalk sealing member.

Figure 1:
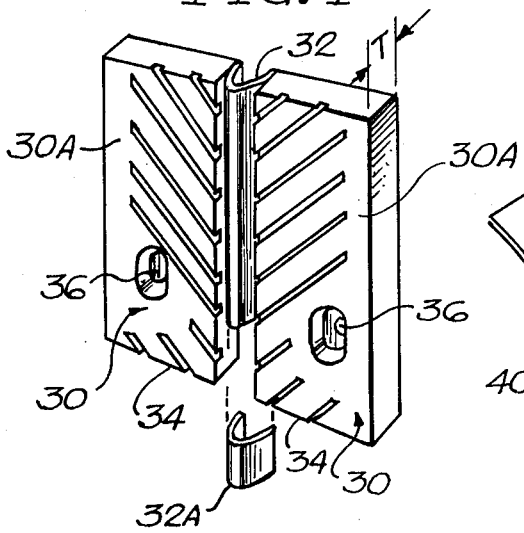
FIG. 1 is a perspective view of a curb gap bridging member adapted for use in the curb and gutter sealing assembly of this invention.

Referring first to FIG. 14, a typical curb and gutter gap and intersection sealing assembly A of this invention is shown juxtaposed with a curb and gutter gap in which the roadway gap extends at a substantial skew. As there shown, assembly A seals the gap and intersection between a pair of slabs S which define a space or gap G between them. Gap G extends across the roadway to the curb and then extends upwardly along the curb to form a curb gap portion G′ between curb slab portions C. It is gap G in the gutter area and gap G′ in the curb area, and the intersection of gap portions G, G′, which the curb and gutter sealing assemblies of this invention are adapted to seal.

Substantially the entire length of the skewed gap G may be bridged by a plurality of end dam sections which may be made and assembled in accordance with the disclosure of U.S. Pat. No. 3,713,368. These may comprise a plurality of individual end dam sections (not shown), each comprising a pair of spaced longitudinally extending parallel side pads joined centrally by a gap-bridging flexible joint membrane. One of these end dam sections may be of a shorter length or may be cut to a skew, and this is illustrated by end dam section 20 which comprises a pair of spaced longitudinally extending parallel side pads 22 joined by joint membrane 24. Joint membrane 24 has an upstanding arched configuration for the purpose described in U.S. Pat. No. 3,713,368. End dam section 20 may be assembled into the curb and gutter gap intersection sealing assembly A of this invention in the factory and shipped to the job site, such as in the form illustrated in FIG. 15, or, alternatively, it may be joined with a curb and gutter sealing assembly at a job site, in the manner to be described.

Referring now to FIGS. 1 to 8, a curb and gutter sealing assembly 10 (FIG. 7) of this invention includes a curb gap bridging member comprising a pair of elongate, parallel, spaced-apart pads 30 joined by an elongate flexible joint membrane 32 which has a preformed, self-sustaining, upstanding arched configuration. Pads 30 have front and rear surfaces 30A and 30B respectively, and define suitably reinforced stud receiving holes or slots 36. The joint membrane, adjacent the lower ends 34 of the side pads 30, is removed for a purpose to be described. As such the joint membrane 32 terminates a distance upwardly from the lower ends of the side pads, which distance is preferably at least about equal to the thickness T of the side pads. The side pads and flexible joint membrane may be formed and made in accordance with U.S. Pat. No. 3,713,368. The cut-out portion 32A of the flexible joint membrane which is removed may be saved for use in the manner to be described.

Figure 2:
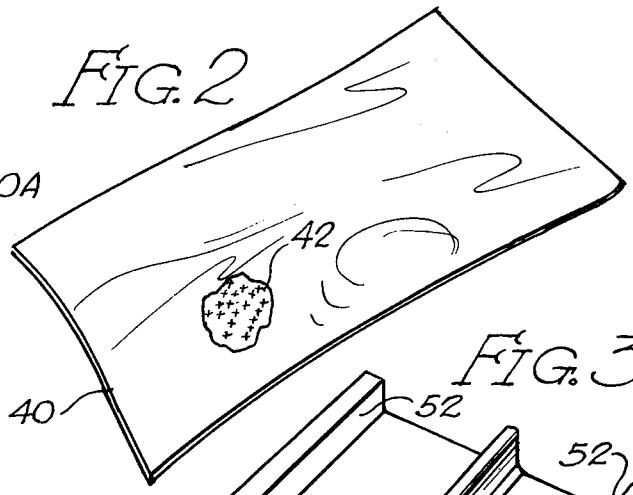
FIG. 2 illustrates a flexible sealing flap member adapted for use in the curb and gutter sealing assembly of this invention.

FIG. 2 illustrates an expansive flexible sealing flap member 40 adapted to be integrated into the assembly 10, and to be joined with the curb gap-bridging member of FIG. 1. Member 40 is preferably formed of rubber or synthetic rubber, such as neoprene, which is fabric reinforced, as by a fabric layer 42 which may be of a woven polyester fabric, or the like. Member 40 is relatively limp and is much more highly flexible than is the pre-formed, self-sustaining, joint membrane 32. Member 40 is much thinner than is the joint membrane 32. Typically, member 40 may be about 0.055 inch thick, whereas the average thickness of the joint membrane 32 may be about 0.150 inch thick. The flap member 40, by virtue of its relatively limp character, is readily conformable to various shapes, whereas the joint membrane 32 is preferably of a self-sustaining shape. Flap member 40 is sealingly secured to the rear surfaces of pads 30 and to the rear surfaces of the joint membrane. As such, flap member 40 and the joint membrane seal the gap or space between the pads for its entire length. The member 40 then extends forwardly of the lower ends 34 of the pads 30.

Figure 3:
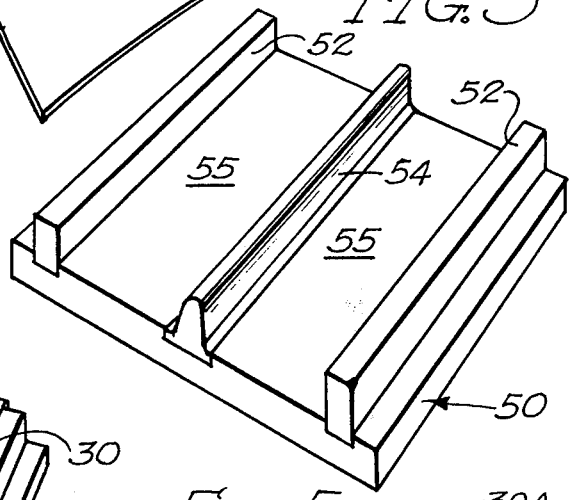
FIG. 3 illustrates a splice mold which may be used in connection with forming a curb and gutter sealing assembly of this invention.
Figure 4:
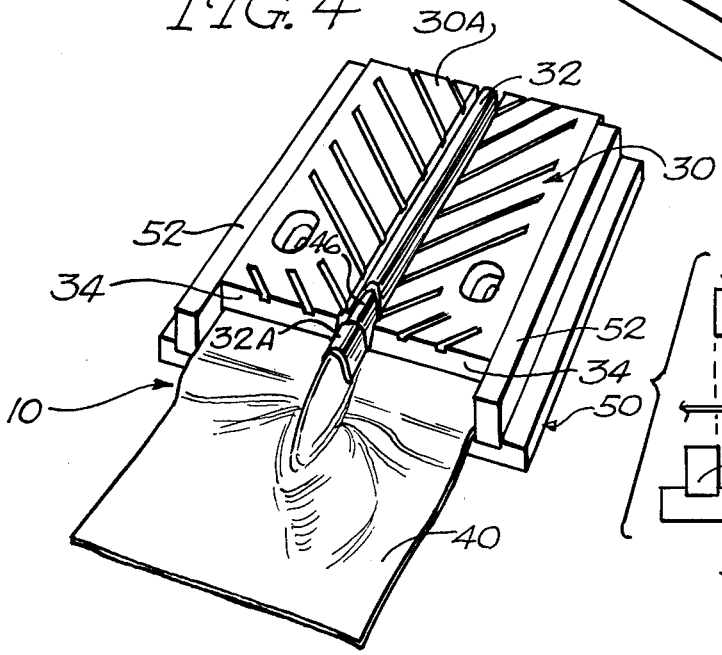
FIG. 4 illustrates the members of FIGS. 1 and 2 juxtaposed with the splice mold of FIG. 3 and ready for bonding to each other.
Figure 5:
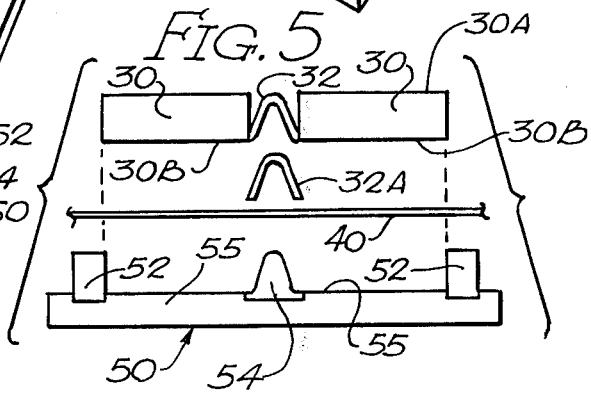
FIG. 5 is an exploded perspective view illustrating the assembly of FIG. 4.

A typical splice mold 50 for holding the components of the curb and gutter sealing assembly 10 as they are being secured and bonded to each other is shown in FIG. 3. Splice mold 50 provides side bars 52 for confining and locating the pads 30 and a center bar 54 substantially conforming to the shape and configuration of the joint membrane 32 for locating the joint membrane 32. As shown by FIG. 5, the flap member 40 is first positioned over, and is then made to conform to the shape of center bar 54. The lateral portions of member 40 then lie flat against the floor surfaces 55 of splice mold 50. Thereafter, as illustrated by FIG. 4, the side pads 30 and associated joint membrane 32 are positioned over the sealing flap member 40 with their rear surfaces 30B confronting flap member 40 and the short joint membrane portion 32A is positioned over the front surface of the sealing flap member 40 commencing at the lower ends 34 of the adjacent side pads. Cut-out portion 32A is seen to extend away from the side pads a distance equal to at least about the thickness T of the side pads.

Suitable adhesive to promote adhesive bonding is appropriately positioned between each side pad 30, joint membrane 32, sealing flap member 40 and portion 32A thereby to provide adhesive bonds. After the adhesive and components are positioned in the splice mold 50, a mating top portion of the splice mold (not shown) may be positioned over the components, following which the assembly 10 is suitably cured, as in a molding press under heat and pressure.

When the curb and gutter sealing assembly 10 shown in FIG. 4 has been suitably cured and bonded, the projecting sealing flap 40 retains its highly flexible and relatively limp character except that it provides a self-sustaining, upstanding arched, folding control zone 44 in the region where joint membrane portion 32A has been integrated with the sealing flap 40, which zone is of substantially greater rigidity than the main body of the sealing flap. As seen in FIG. 4, this self-sustaining, upstanding arched, folding control zone 44 is disposed in-line with the joint membrane 32, commences at about the lower ends 34 of the side pads, and is spaced from the joint membrane by an intermediate highly flexible portion 46 of the main body of the sealing flap 40.

The curb and gutter sealing assembly 10 is adapted to be secured to curb and gutter portions of adjacent roadway slabs, as has been explained. In that connection, the sealing flap portion which extends from the lower ends 34 of the side pads 30 is adapted to overlie a gutter gap. The side pads 30 are adapted to confront and to be secured to upstanding curb portions of adjacent roadway slabs adjacent the intersection of a curb and gutter gap. The side pads 30 and joint membrane 32 are therefore intended to be moved from their generally coplanar relationship with the remainder of sealing flap 40 as illustrated by FIG. 4, i.e. from a position in which the control zone 44 and joint membrane are in-line, to a variety of angular relationships, such as to the 90 degree curb and gutter relationship illustrated by FIGS. 7 and 8.

Figure 6:
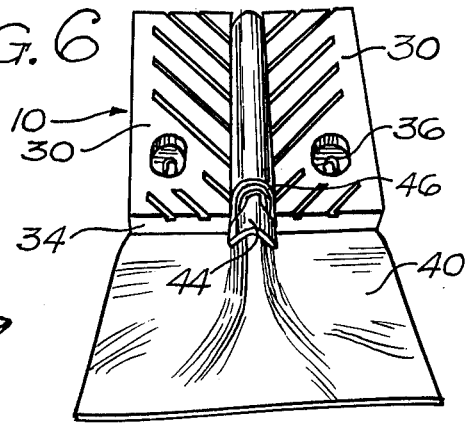
FIG. 6 is a view showing an intermediate position between the positions of the curb and gutter sealing assembly of FIGS. 4 and 7.
Figure 7:
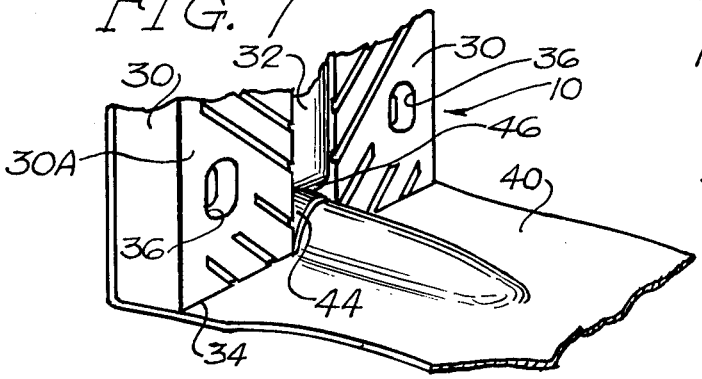
FIG. 7 is a perspective view illustrating a curb and gutter sealing assembly of this invention with portions disposed in intersecting planes representative of a 90 degree curb and gutter intersection.

As shown by FIGS. 4, 6 and 7, when the side pads 30 and joint membrane 32 are secured to curb portions of the slabs the flap member moves from a position which is generally coplanar with the pads and membrane, as shown by FIG. 4, into a plane which is generally horizontal with respect to the gutter portions of a roadway gap, as shown by FIG. 7. As that movement occurs, the flap folds about the first or lower ends of the side pads. As that takes place, the self-sustaining, upstanding arched, folding control zone 44 begins to be displaced (see FIG. 7) to a position below the joint membrane 32 and into the area between the side pads 30 readily, and without bunching, wrinkling or other distortion of the intermediate substantially more highly flexible portion 46 of the main body of the sealing flap, i.e., the portion between the folding control zone 44 and the joint membrane 32. Thus, it can be seen that a sealing assembly 10 of this invention provides for the controlled folding of the sealing flap, thereby neatly to accommodate that displacement of the sealing flap which is necessary to make the angular transition from the plane of the curb portions of the slab to the plane of the main body of the sealing flap which is disposed in and overlies the gutter portions and a gutter gap portion of the roadway slabs. When so folded, intermediate flexible portion 46 overlies and confronts control zone 44 neatly and is shaped by the control zone into a configuration which is similar to the shape of the control zone. The control zone promotes and localizes the folding into the region between the front and rear surfaces of the side pads 30, and away from roadway traffic forces, thereby to protect the joint membranes and portions of assembly 10 which move in response to temperature changes. The single thickness of the sealing flap member 40 which will then underlie an end dam section in the gutter, such as section 20, minimizes problems in providing an effective sealing thereat.

Figure 12:
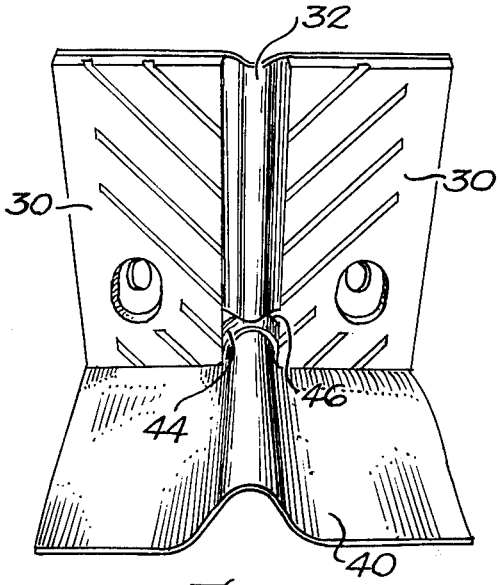
FIG. 12 is a view similar to FIG. 7 with the flexible sealing flap member angled to accommodate a no-skew roadway gap.
Figure 13:
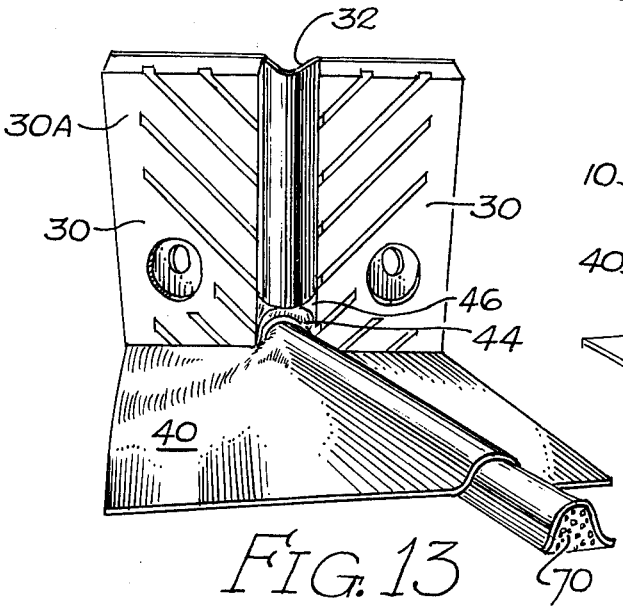
FIG. 13 is a view similar to FIG. 12 with the flexible sealing flap member angled to accommodate a roadway gap having a substantial skew.

The self-sustaining shape of the folding control zone 44 also tends to promote the shaping of the central region of the sealing flap at the front end of the control zone into a convolution having an upstanding arched configuration of substantially the same cross-sectional shape as the control zone so that it may readily be made to conform to the joint member of an end dam section, such as the joint membrane 24 of end dam section 20. Not only does it promote the formation of a conforming central portion of the flap 40 when there is zero skew, as illustrated by FIG. 12, but the control zone 44, by being self-sustaining, also promotes the shaping of the main body portion of flap member 40 into a convolution which extends at a skew angle to the side pads, as is illustrated by FIG. 13. The convolution may readily be conformed then to the shape of an end dam joint membrane, such as to a joint membrane 24, all without bunching and wrinkling.

Figure 9:
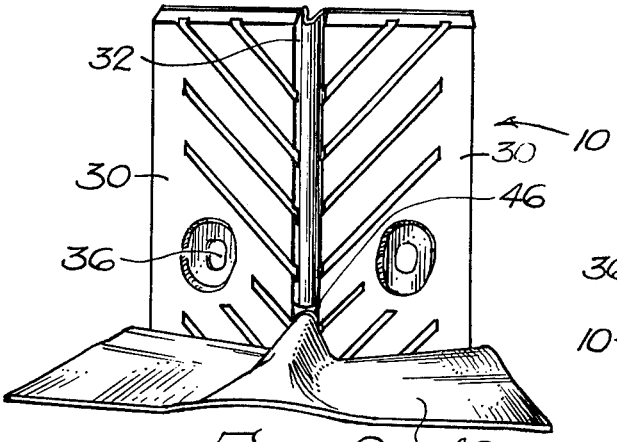
FIG. 9 is a front view, similar to FIG. 7, representing the roadway slabs in a position in which they have moved towards each other, such as due to elevated temperatures.
Figure 10:
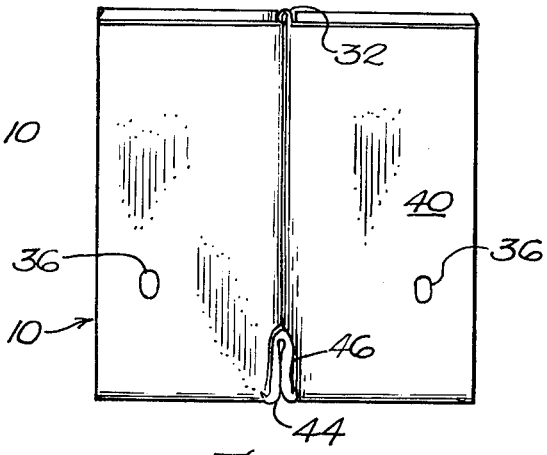
FIG. 10 is a rear elevational view of FIG. 9.
Figure 11:
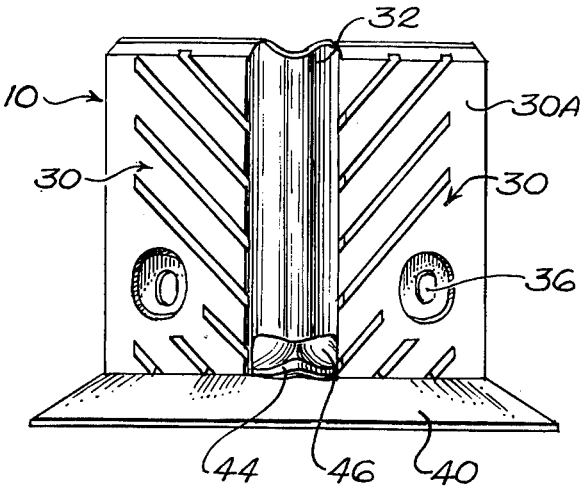
FIG. 11 is a front view, similar to FIG. 9, representing the roadway slabs in a position in which they have moved away from each other at the gap, such as due to cold weather.
Figure 8:
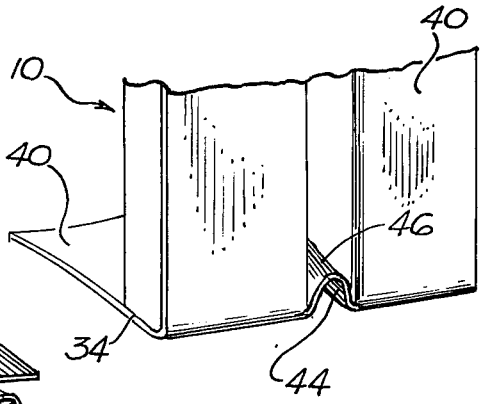
FIG. 8 is a rear perspective view of the assembly of FIG. 7.

FIGS. 9, 10 and 11 illustrate the curb and gutter sealing assembly 10 of this invention, in compressed and expanded conditions, typical, respectively, of hot and cold weather conditions, following installation at a mean temperature condition, such as that illustrated by FIGS. 7 and 8. In all cases, the control zone 44 formed by the presence of portion 32A is preferably dimensioned so that it and the associated flap 44 does not forcefully engage the joint membrane 32 in any position of the assembly in use.

A curb and gutter sealing assembly 10 may be formed as described and may then be secured to a curb, as by suitable studs and nuts F, as in the manner described in U.S. Pat. No. 3,713,368. Following installation, a gutter gap section, such as end dam section 20, may be juxtaposed with and sealingly secured to the portion of the sealing flap 40 extending from ends 34 of side pads 30, thereby to form an assembly A. The convolution formed in the sealing flap 40, such as the convolution illustrated in FIG. 13, may be supported during installation, as by a foam mandrel 70, as described by U.S. Pat. No. 3,814,530, thereby to promote conformity with the underside of a joint membrane 24 and to provide a well-sealed joint.

Alternatively, a sealing assembly A, FIG. 15, may be factory completed as by sealingly securing an end dam section 20 to a sealing flap 40 to provide an assembly A. This may readily be done when the gap skew is known or when the installation is to be made in a roadway in which there is no skew angle between the curb and the gutter portions of the gap. Such pre-assembly insures a positive bond and seal, independent of environmental and installation conditions which may be encountered at a job site.

In environments where the curb portions of the slabs terminate upwardly in sidewalk or like slab portions, and sealing of a gap between the sidewalk slab portions is also desired, that can also be accomplished in accordance with this invention. Referring now to FIGS. 17 to 19, a flexible sealing flap member 100 which may be an upper extension of sealing flap 40, or which may be a separate, like member, is sealingly secured to the rear surfaces of side pads 30' and joint membrane 32'. Flap member 100 extends away from the upper ends 102 of the side pads and joint membrane.

After the curb and gutter sealing assembly is secured to the slabs, such as is illustrated by FIG. 14, the flap member 100 is manipulated to overlie the sidewalk gap so that it may be sealingly secured with a sidewalk and dam section 110 to slab portions of the sidewalk adjacent the gap between the slabs.

To provide for the transition from the generally vertical or upstanding plane of the flap member 100 illustrated by FIG. 17 to the generally horizontal plane of FIGS. 18 and 19, the flap 100 is first folded forwardly so that first flap portions overlie the upper ends 102 of the side pads 30'. The flap 100 is then folded rearwardly, reverse folded, so that reverse folded portions overlie the first folded portions, generally as seen in FIG. 18. At this time, the intermediate or central portion of the flap which had projected rearwardly from the joint membrane 32' provides a convolution 104 of an upstanding, generally arched configuration which merges, without wrinkles or bunching, with the joint membrane 32'. As seen in FIG. 19 the convolution 104 merges with membrane 32' in a merging flap region 108 which is highly flexible and which does not interfere with the intended action of the end dam sections as the roadway slabs move relative to each other. Because of the reverse folding, the forward edge 106 of the folded sealing flap is closed to prevent the passage of water therethrough.

After the sealing flap has been appropriately folded, a suitable shaping mandrel, as typified by mandrel 70 (FIG. 13), may be positioned below the convolution formed centrally in the flap, thereby to promote effective sealing between the convolution and a sidewalk end dam section 110 which is positioned over the sidewalk gap.

An entire assembly including curb, gutter and sidewalk end dam sections may be factory assembled for shipment to and use at a job site. Alternately, the sidewalk dam section may be secured at the job site with suitable adhesive, as in the manner described hereinbefore.

It will be clear from the foregoing description that various alternatives to the specific embodiments disclosed may be employed, all without departing from the spirit and scope of this invention. For example, the membrane portion 32A may be secured to the rear face of the sealing flap. Indeed, control zones rendered more rigid than other portions of the sealing flap may be provided by other than membrane portions 32A, as, for example, by molding a flap 40 with a thickened portion or with other rigidifying material. Accordingly, I do not intend to be limited, except insofar as may be required by the claims.

I claim:

1. An assembly for sealing the intersection of curb and gutter portions of adjacent roadway slabs comprising elongate parallel, spaced-apart side pads having front and rear surfaces and first and second ends, an elongate flexible joint membrane having a pre-formed, self-sustaining, upstanding arched configuration and sealingly joining said side pads, and having front and rear surfaces, and an expansive flexible sealing flap sealingly secured to said side pads and to said joint membrane for sealing a gap between curb and gutter portions of adjacent roadway slabs and for promoting controlled folding of the sealing flap at the region where angular transition from the plane of the curb to the plane of the gutter occurs, and said joint membrane terminating a distance from said first ends of said side pads equal at least to about the thickness of said side pads, said flexible sealing flap extending away from said side pads and being substantially more flexible than is said joint membrane, said sealing flap comprising a main body portion which is relatively limp and a rigidified portion providing a self-sustaining, upstanding arched control zone, which control zone is substantially more rigid than the relatively limp main body portion of said sealing flap, said control zone commencing at about said first ends of said side pads and extending away from said first ends a distance equal to at least about the thickness of said side pads, said control zone, when said side pads and flap are generally coplanar, extending in line with said joint membrane, said joint membrane being connected to said control zone by an intermediate relatively limp flexible portion of said main body which is substantially more flexible and less rigid than is said control zone and than is said joint membrane, whereby when said side pads and joint membrane are folded upwardly out of the plane of said sealing flap and relative to said sealing flap to position the upwardly extending portion of the joint membrane over said control zone, said control zone promotes controlled folding of said intermediate portion neatly between said joint membrane and said control zone and said control zone becomes disposed in the area between said side pads and beneath said joint membrane, and without bunching and wrinkling of said intermediate portion.

2. An assembly in accordance with claim 1 in which said flexible sealing flap is sealingly secured to the rear surfaces of said side pads and said joint membrane.

3. An assembly in accordance with claim 1 in which said side pads and said joint membrane are upstanding and the rear surfaces of said side pads lie in a plane disposed at a substantial angle to the plane of the portion of said flexible sealing flap which extends away from said side pads, and wherein said intermediate flexible portion neatly overlies and confronts said control zone and is shaped by the control zone into a configuration which is similar to the shape of said control zone.

4. An assembly in accordance with claim 3 in which said first ends of said side pads confront and overlie portions of said flexible sealing flap which extend away from said side pads.

5. A sealed gap at the intersection of curb and gutter portions of adjacent spaced roadway slabs comprising an upstanding sealing assembly secured to the curb portions of said adjacent roadway slabs, said assembly comprising a pair of spaced-apart, adjacent side pads having front and rear surfaces and being joined by an elongate flexible joint membrane having a preformed, self-sustaining upstanding arched configuration, said side pads being secured to curb portions of said slabs, and said joint membrane overlying and confronting a curb gap portion, and an expansive flexible sealing flap sealingly secured to said side pads and to said joint membrane and extending from the lower ends of said side pads and said joint membrane and extending forwardly and away from said front surfaces and overlying and confronting adjacent gutter portions of said roadway slaps and gap, and wherein said joint membrane terminates a distance upwardly from the lower ends of said side pads equal at least to about the thickness of said side pads, said flexible sealing flap being substantially more flexible than said joint membrane, said sealing flap comprising a main body portion which is relatively limp and a rigidified portion providing a self-sustaining, upstanding arched control zone, which control zone is of substantially greater rigidity than is the main body of said sealing flap, said control zone commencing at about said lower ends of said side pads and at the rear surfaces thereof and overlying and extending in the direction of said gutter gap to at least about the front surfaces of said side pads, said control zone thereby lying between the front and rear surfaces of said side pads and being positioned below the upwardly extending portion of said joint membrane, and wherein said sealing flap defines a neatly folded limp flexible intermediate portion which is more flexible than said control zone, said limp flexible intermediate portion extending forwardly below said joint membrane and from the rear of said control zone and over and confronting said control zone in a configuration similar to the shape of said control zone, and without bunching and wrinkling of said folded flexible intermediate portion.

6. A sealed gap at the intersection of curb and gutter portions of adjacent spaced roadway slabs in accordance with claim 5 in which said control zone comprises a cut-out portion of a said joint membrane, said cut-out portion being secured to said flexible sealing flap.

7. A sealed gap at the intersection of curb and gutter portions of adjacent spaced roadway slabs in accordance with claim 5 in which said flexible sealing flap is sealingly secured to the rear surfaces of said side pads and said joint membrane.

8. A sealed gap in accordance with claim 5 in which said flexible sealing flap is shaped to define a convolution of substantially the same cross-sectional shape as said control zone at the front end of said control zone.

9. A sealed gap in accordance with claim 8 in which an end dam section having side pads and a joint membrane is sealingly secured to said flexible sealing flap, with said joint membrane being sealingly secured to said convolution and with said side pads being sealingly secured to portions of said sealing flap adjacent said convolution, and wherein said end dam section overlies gutter and gutter gap portions of said slabs.

10. A sealed gap in accordance with claim 8 in which said convolution extends from the front end of said control zone at a skew angle thereto.

11. A method of sealing a gap at the intersection of curb and gutter portions of adjacent roadway slabs, comprising the steps of providing elongate parallel, spaced-apart side pads having front and rear surfaces and first and second ends, an elongate flexible joint membrane having a pre-formed, self-sustaining, upstanding arched configuration and sealingly joining said side pads, and having front and rear surfaces, and an expansive flexible sealing flap sealingly secured to said side pads and joint membrane for sealing a gap between curb and gutter portions of adjacent roadway slabs and for promoting controlled folding of the sealing flap at the region where angular transition from the plane of the curb to the plane of the gutter occurs, and said joint membrane terminating a distance from said first ends of said side pads equal at least to about the thickness of said side pads, said flexible sealing flap extending away from said side pads and being substantially more flexible than is said joint membrane, said sealing flap comprising a main body portion which is relatively limp and a rigidified portion providing a self-sustaining, upstanding arched control zone, which control zone is substantially more rigid than the main body of said sealing flap, said control zone commencing at about said first ends of said side pads and extending away from said first ends a distance equal to at least about the thickness of said side pads, said control zone, when said side pads and sealing flap are generally coplanar, extending in line with said joint membrane, said joint membrane being connected to said control zone by an intermediate, relatively limp flexible portion of said main body which is substantially more flexible and less rigid than said control zone and than said joint membrane, securing said side pads to upstanding curb portions of adjacent slabs, folding said flap into a generally horizontal plane about the first ends of said side pads to overlie gutter portions of said slabs and a gutter gap portion while disposing said control zone between said side pads and below said joint membrane, thereby to position the upwardly extending portion of the joint membrane over said control zone, said control zone promoting a controlled folding of said intermediate portion neatly and without bunching and wrinkling between said joint membrane and said control zone.

12. A method in accordance with claim 11 in which said flexible sealing flap is sealingly secured to the rear surfaces of said side pads and said joint membrane.

13. A method in accordance with claim 11 in which said intermediate flexible portion is positioned to neatly overlie and confront said control zone and is shaped by the control zone to assume a configuration similar to the shape of said control zone.

14. A method in accordance with claim 13, comprising the further step of shaping the portion of said flexible sealing flap which extends away from said side pads into a convolution of substantially the same cross-sectional shape as said control zone.

15. A method in accordance with claim 14, in which said convolution is directed away from the end of said control zone at a skew angle to said side pads.

16. A method in accordance with claim 11 comprising the further step of sealingly securing an end dam section to said flexible sealing flap.

* * * * *

UNITED STATES PATENT OFFICE

CERTIFICATE OF CORRECTION

PATENT NO. : 4,033,702

DATED : July 5, 1977

INVENTOR(S) : John C. Moerk, Jr.

It is certified that error appears in the above-identified patent and that said Letters Patent are hereby corrected as shown below:

Col. 2, line 4, "sides" should be -- side --;

Col. 3, line 63, "purpose" should be -- purposes --;

Col. 7, line 4, "and" should be -- end --;

Claim 5, Col. 9, line 2, "slaps" should be -- slabs --;

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*